US006305038B1

(12) United States Patent
Elkhuizen et al.

(10) Patent No.: US 6,305,038 B1
(45) Date of Patent: Oct. 23, 2001

(54) BASE ASSEMBLY

(75) Inventors: Jan Willem Elkhuizen, Leeuwarden; Jeroen Maarten Janssen, Groningen, both of (NL)

(73) Assignee: Bakker & Elkhuizen Ergonomie B.V. (NL)

( * ) Notice: Subject to any disclaimer, the term of this patent is extended or adjusted under 35 U.S.C. 154(b) by 0 days.

(21) Appl. No.: 09/509,855

(22) PCT Filed: Sep. 30, 1998

(86) PCT No.: PCT/NL98/00567

§ 371 Date: Aug. 4, 2000

§ 102(e) Date: Aug. 4, 2000

(87) PCT Pub. No.: WO99/17640

PCT Pub. Date: Apr. 15, 1999

(30) Foreign Application Priority Data

Oct. 3, 1997 (NL) ..... 1007201

(51) Int. Cl.[7] ..... A47C 23/06
(52) U.S. Cl. ..... 5/241; 5/238; 5/239
(58) Field of Search ..... 5/236.1, 238, 239, 5/241, 244

(56) References Cited

U.S. PATENT DOCUMENTS 4,477,935 * 10/1984 Griffin ..... 5/241
4,525,886 * 7/1985 Savenije ..... 5/236.1 X
5,038,429 * 8/1991 Elmalek et al. ..... 5/238 X
5,127,114 * 7/1992 Horburger ..... 5/239
5,524,307 * 6/1996 Griffin ..... 5/241

FOREIGN PATENT DOCUMENTS

3232123 * 3/1984 (DE) ..... 5/238
4023289A1 1/1992 (DE) ..... A61G/7/018
038 155A 10/1981 (EP) ..... A47C/23/06
0116237 * 8/1984 (EP) ..... 5/239
94 01 OZ4A 1/1994 (WO) ..... A47C/23/06

* cited by examiner

*Primary Examiner*—Michael F. Trettel
(74) *Attorney, Agent, or Firm*—Mark Zovko

(57) ABSTRACT

Base assembly for a bed or chair seat. The assembly includes at least one medium-filled flexible support member and a number of substantially form-retaining bearing elements. The bearing elements rest on the support member such that the bearing elements together provide a bed surface. The base assembly preferably has at least two medium-filled flexible support members and the bearing elements are supported individually by a plurality of support members. The bearing elements can be slats, while the support members can be made from fiber-reinforced flexible plastic material.

12 Claims, 3 Drawing Sheets

BASE ASSEMBLY

BACKGROUND OF THE INVENTION

1. Field of the Invention

The invention relates to a base assembly for instance a bed base or chair seat.

2. Description of the Prior Art

There exists a wide diversity of base assemblies for supporting a body such as a human body. Base assemblies for use in a bed, known as bed bases, exist in many variants. There are for instance bed springs, slatted bases which may or may not be flexible, and water beds. All these bed bases can be covered with a cover element such as for instance a mattress, molton, tatami, etc. The base assembly, whether or not in combination with cover element, serves to support a prone person. A more or less uniform support of the body is usually sought after here, in combination with a greater or lesser degree of firmness/stability of the support. A drawback here is that optimizing of uniformity of support (the water bed) cannot be combined with a great firmness/stability of the support.

SUMMARY OF THE INVENTION

The object of the present invention is to provide a base assembly with which a very uniform support of a body can be combined with a relatively great firmness/stability of the support. It is also an object to embody such a construction in the simplest possible manner.

The present invention provides for this purpose a base assembly, for instance a bed base or chair seat comprising:

at least one medium-filled flexible support member, and a number of substantially form-retaining bearing elements, wherein the bearing elements rest on the support member such that the bearing elements together form a base surface.

The base assembly preferably comprises at least two medium-filled flexible support members and the bearing elements are individually supported by a plurality of support members. The medium-filled flexible support member provides a uniform pressure distribution of the support member on the different bearing elements supported by the support member. When one bearing element is loaded much more heavily than other bearing elements, it will be forced further downward until the pressure exerted on this bearing element corresponds with the pressure exerted by the support member on other bearing elements supported by the support member. The substantially form-retaining bearing elements ensure however that the created supporting surface continues to have a great firmness/stability. Such a base assembly provides a resilient support in inexpensive manner. The construction of the base assembly is very simple. Due to the resilient support the quality of the cover element is less relevant and there is no longer any need of for instance an expensive mattress. A thinner mattress can thus already result in good support. A latex mattress can thus be used in a relatively thin form.

In a preferred embodiment the support member has a closable opening for feeding and draining the medium to and from the support member. By varying the pressure in the support member the firmness of the base assembly can be varied in very simple manner, at least in respect of the firmness between the individual bearing elements. It is for instance possible to adapt a base assembly as required to personal wishes and/or subject to the weight of a body placed on the base assembly. It is even conceivable to automatically vary the filling pressure of a support member on the basis of a weight detected by scales.

When the base assembly comprises a plurality of support members which are mutually connected such that the medium of one support member is in open communication with the medium of another support member, the filling pressure will after a time be everywhere the same in the connected support members. The supporting pressure exerted by the connected support members will hereby be the same everywhere. This results in an even more uniform support by the base assembly.

The support member is preferably provided with coupling means for fixing the bearing elements to the support member. These coupling means can be formed for instance by insertion openings for the bearing elements in the jacket of the support member. In order to prevent the support member and bearing elements moving relative to each other, a coupling between the two is desirable. The insertion openings make assembly, disassembly and conversion of the base assembly very simple.

The support member preferably has a substantially elongate form. A cross-section of such a support member is preferably provided with at least one straight side. The elongate form of the support member enables support of a large number of bearing elements using one support member, which bearing elements will hereby support the body in uniform manner. The advantage of a cross-section with at least one substantially straight side is that due to this form the support member will occupy a stable position and the danger of the support member rotating is minimized.

The support member is preferably manufactured from a fibre-reinforced flexible plastic. This material is firm and relatively simple to model into the desired shape. An example is a support member manufactured from woven nylon with a polyurethane coating. The woven nylon is sufficiently strong and also defines the maximum size of the support member. An additional covering of such a support member is no longer necessary. The polyurethane coating limits the medium permeability of the support member such that no additional measures are required to make the support member medium-impermeable.

The bearing elements can be formed by slats. These are inexpensive and make acceptance of the base assembly according to the invention as bed base relatively easy since the base assembly hereby has an appearance which does not differ so very much from already existing base assemblies. In order to increase its firmness, the base assembly also comprises a frame for supporting the side of the support member remote from the bearing elements. The support member is preferably coupled to the frame. In addition to the advantage of the great firmness, it is also possible to displace the base assembly relatively simply using the frame. Yet another possibility is fixing of base assembly surrounds to the frame.

In a preferred embodiment the support member comprises two external protruding flaps for receiving coupling parts for the bearing elements. These flaps are preferably provided with openings for partial passage of the coupling parts. When the bearing elements are also provided with recesses, the coupling parts can engage on the bearing elements. For an even better anchoring of the bearing elements on the support members, these latter are connectable to the coupling parts via fastening pins. Such a base assembly can be assembled in simple manner since it consists of only a few components. The construction of the components can also be very simple. Another advantage is that the coupling of bearing elements to support members can be released, for instance in order to replace particular components.

For an aesthetically acceptable finish of the base assemblies, the outer ends of the bearing elements are provided with a covering element. An additional advantage is that the engagement of coupling parts on bearing elements is such that this does not affect the comfort of the user of the base assembly. There are after all no protruding parts on the side of the base assembly directed toward the user.

In yet another preferred embodiment the support members are connected to an adjustable valve with which, as required, the support members can be coupled for pressure equalization and can be separated in order to prevent pressure equalization. Such a control valve can for instance be provided with a central connection so that a pump coupled to a central connection point can fill all the individual support members. The control valve must be provided for this purpose with a number of switch positions. Switch positions can thus be envisaged for individual connection of each of the support members to a connecting opening. Another possibility is a position in which all support members are in mutual connection. In this latter position the medium pressure in the individual support members will increase uniformly during filling of the support members. In order to prevent a base assembly being depressed very far locally, for instance when someone sits on the edge of a bed base, it is also desirable for the control valve to have a position in which the individual support members are mutually separated. A further option is to provide the control valve with a central outlet for relieving the pressure in the support members.

BRIEF DESCRIPTION OF THE DRAWINGS

The present invention will be further elucidated with reference to the non-limitative embodiments shown in the following figures. Herein.

DETAILED DESCRIPTION OF THE PREFERRED EMBODIMENT

Figure 1:
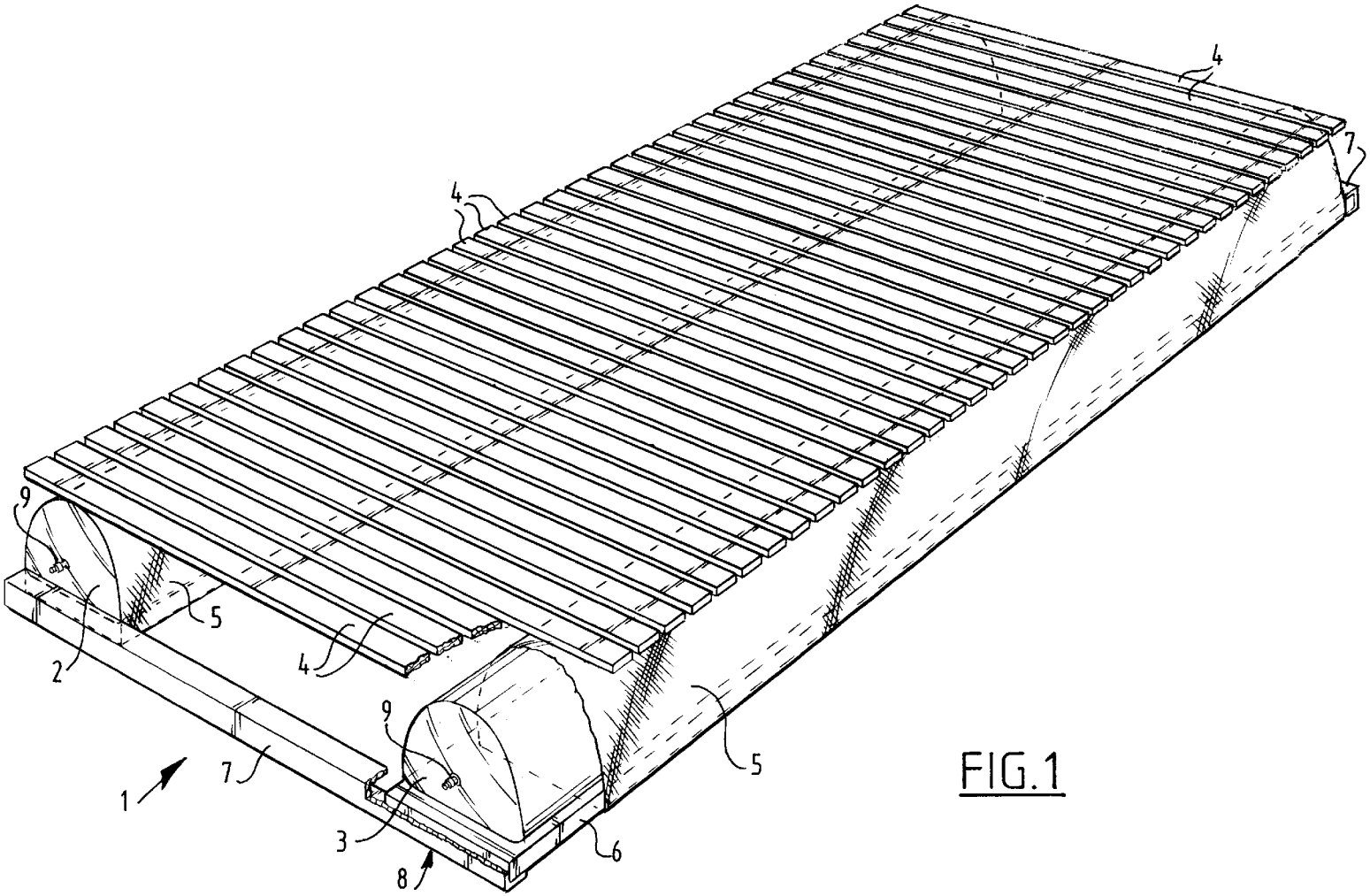
FIG. 1 shows a partly cut-away perspective view of a base assembly according to the invention.

FIG. 1 shows a base assembly 1 with two elongate flexible support members 2, 3 on which a number of substantially form-retaining bearing elements 4 is placed. Bearing elements 4 can be coupled to jackets 5 arranged around support members 2, 3.

Support members 2, 3 are provided on the underside with a flat side with which support members 2, 3 rest on beams 6. These latter are mutually connected by means of profiles 7 to form a frame 8.

This figure also shows that support members 2, 3 are provided with valves 9 with which the filling pressure of support members 2 can be varied. The stiffness of bearing elements 4 can thus be mutually varied.

Figure 2:
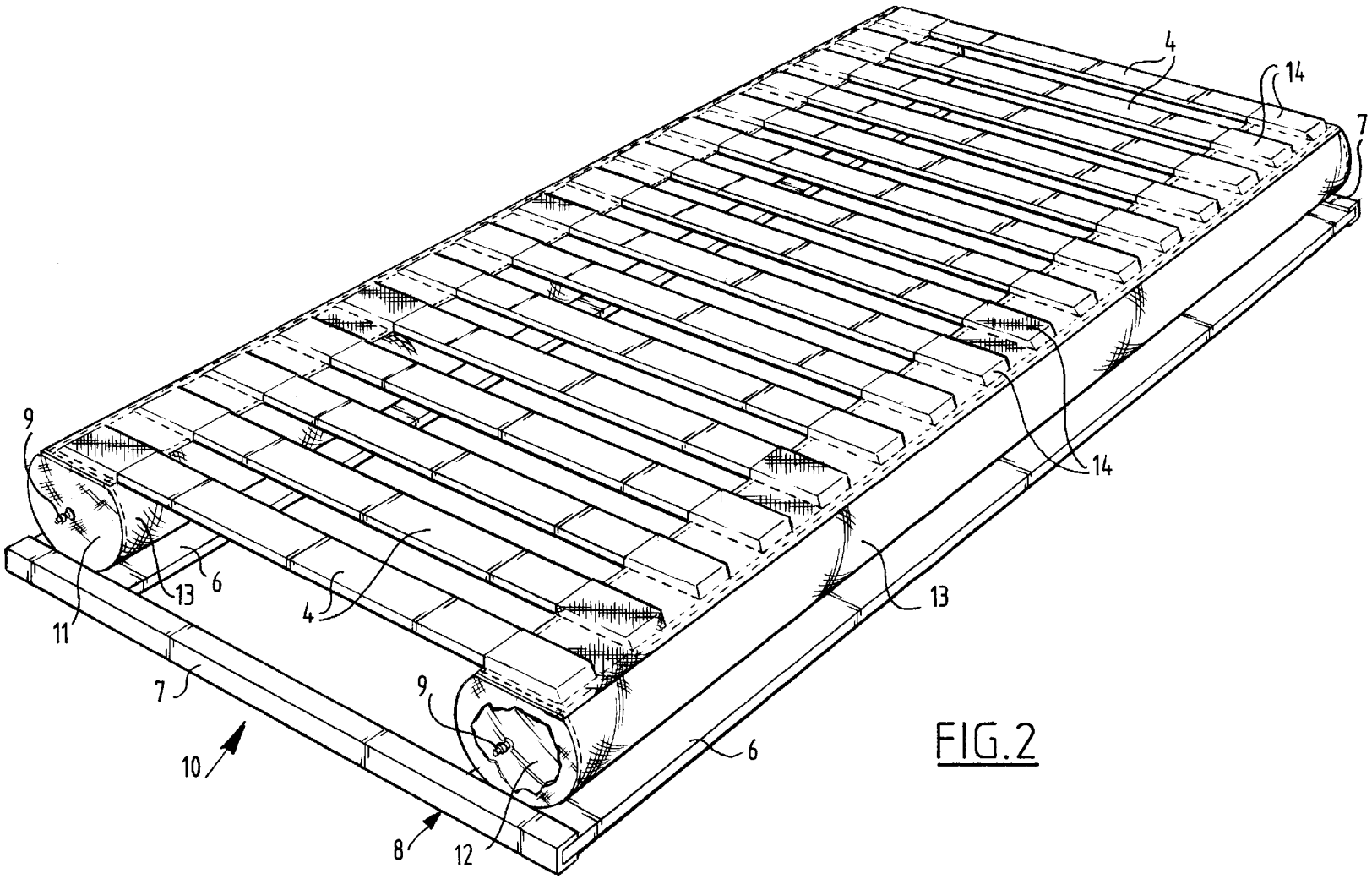
FIG. 2 shows a perspective view of a base assembly with a form differing somewhat from the base assembly shown in FIG. 1.

FIG. 2 shows a base assembly 10 wherein on frame 8 are placed two support members 11,12 with a form differing from the support members 2,3 shown in FIG. 1. Support members 11,12 are provided on the top with a flat side. Arranged around support members 11,12 are jackets 13, manufactured for instance from woven material. This woven material is stitched such that insertion openings are created in jackets 13, whereby bearing elements 4 can be placed in so-called pockets 14. Bearing elements 4 are thus coupled in simple manner to support members 11,12. Support members 11,12 are also provided with valves 9.

Figure 3:
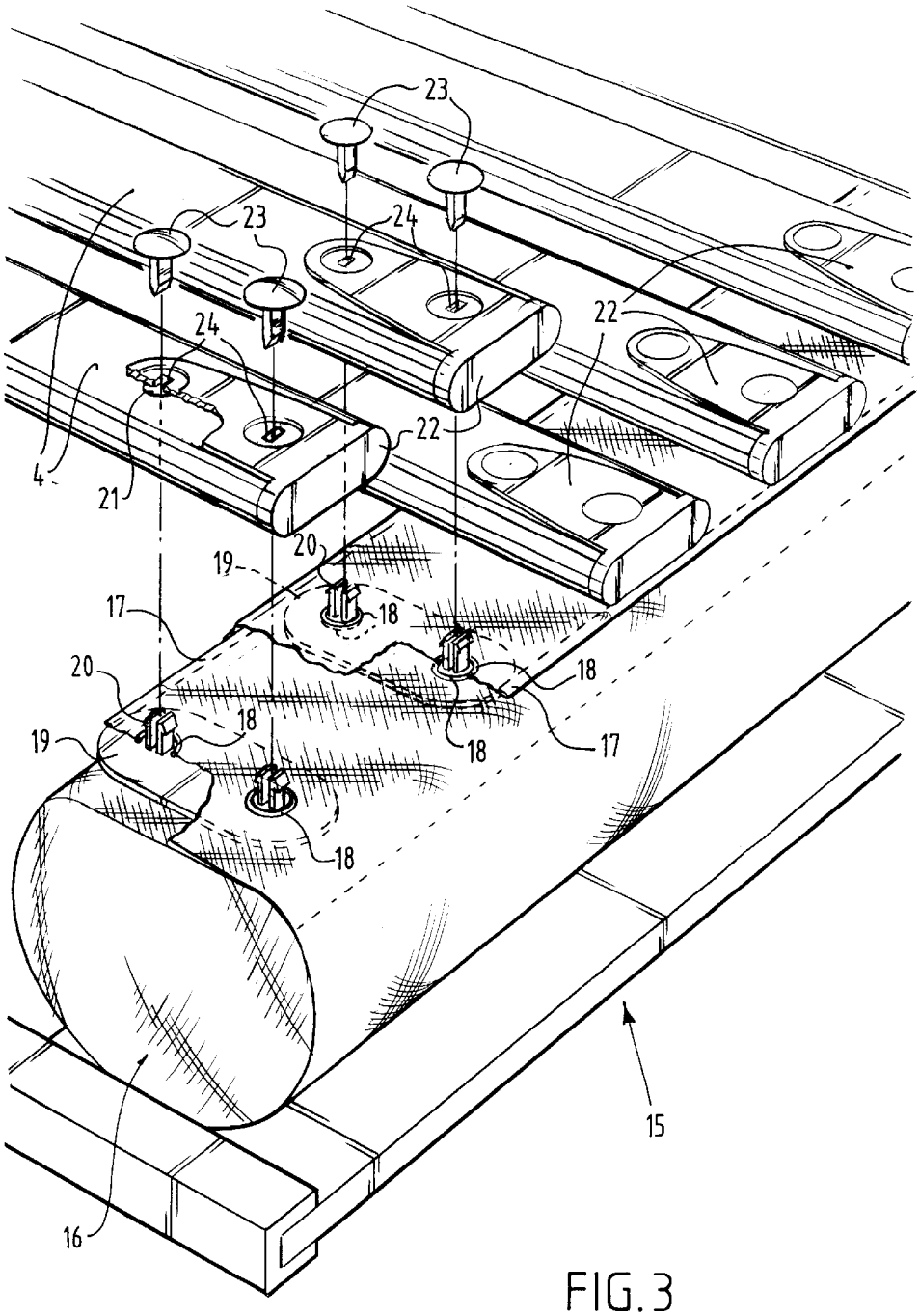
FIG. 3 is a perspective view of another variant of a base assembly according to the invention.

Finally, FIG. 3 shows a bed base 15 in yet another variant. Bearing elements 16 are provided with protruding flaps 17 in which openings 18 are arranged. Slat holders 19 are placed under flaps 17 such that protruding pins 20 of slat holder 19 pass through openings 18. Bearing elements 4 are provided with apertures 21 into which protrude the pins 20 of slat holder 19. The ends of bearing elements 4 are provided with covering elements 22. For a strong fixing of bearing elements 4 on slat holders 19, and thereby also on support members 16, locking pins 23 are placed into openings 14 arranged for this purpose in covering elements 22.

The thus assembled bed base 15 has a simple construction, wherein bearing elements 4, for instance in the case of damage, can be exchanged for a replacement part.

What is claimed is:

1. Base assembly, for a bed base or chair seat, comprising:

at least one medium-filled flexible support member and a number of substantially form-retaining bearing elements, wherein the bearing elements rest on the support member such that the bearing elements together provide a base surface, characterized in that coupling means comprise an individually engageable and releasable coupling for each of said bearing elements, said coupling means fixing the bearing elements to the support member, wherein said support member comprises at least one flap for engaging said coupling between said flap and said support member, and wherein said bearing elements are provided with releases for engaging said coupling.

2. The base assembly of claim 1 wherein said flap of said support member encloses said coupling.

3. Base assembly as claimed in claim 1, wherein the support member comprises two external protruding flaps for receiving and together arresting the coupling for the bearing elements on the support member.

4. Base assembly as claimed in claim 1, wherein the flap is provided with openings for partial passage of the coupling.

5. Base assembly, for a bed base or chair seat, comprising:

at least one medium-filled flexible support member and a number of substantially form-retaining bearing elements, wherein the bearing elements rest on the support member such that the bearing elements together provide a base surface, characterized in that coupling means comprise an individually engageable and releasable coupling for each of said bearing elements, said coupling means fixing the bearing elements to the support member, wherein said support member comprises at least one flap for engaging said coupling between said flap and said support member, and wherein said bearing elements are connected to said coupling by fastening pins.

6. The base assembly of claim 5 wherein said flap of said support member encloses said coupling.

7. Base assembly as claimed in claim 5, wherein the support member comprises two external protruding flaps for receiving and together arresting the coupling for the bearing elements on the support member.

8. Base assembly as claimed in claim 5, wherein the flap is provided with openings for partial passage of the coupling.

9. Base assembly, for a bed base or chair seat, comprising:

at least one medium-filled flexible support member and a number of substantially form-retaining bearing elements having outer ends, wherein the bearing elements rest on the support member such that the bearing elements together provide a base surface, characterized in that coupling means comprise an individually engageable and releasable coupling for each of said bearing elements, said coupling means fixing the bearing elements to the support member, wherein said support member comprises at least one flap for engaging said coupling between said flap and said support member, and wherein said outer ends of said bearing elements are provided with a covering element.

10. The base assembly of claim 9 wherein said flap of said support member encloses said coupling.

11. Base assembly as claimed in claim 9, wherein the support member comprises two external protruding flaps for receiving and together arresting the coupling for the bearing elements on the support member.

12. Base assembly as claimed in claim 9, wherein the flap is provided with openings for partial passage of the coupling.

* * * * *